US010426248B2

(12) United States Patent
Rosenzweig

(10) Patent No.: US 10,426,248 B2
(45) Date of Patent: Oct. 1, 2019

(54) COLLAPSIBLE HAIR BRUSH

(71) Applicant: J & D Brush Co., LLC, Hauppauge, NY (US)

(72) Inventor: Jeffrey S. Rosenzweig, Hauppauge, NY (US)

(73) Assignee: J & D BRUSH CO., LLC, Hauppauge, NY (US)

( * ) Notice: Subject to any disclaimer, the term of this patent is extended or adjusted under 35 U.S.C. 154(b) by 211 days.

(21) Appl. No.: 14/991,765

(22) Filed: Jan. 8, 2016

(65) Prior Publication Data

US 2016/0338479 A1 Nov. 24, 2016

Related U.S. Application Data

(63) Continuation-in-part of application No. 29/527,552, filed on May 20, 2015, now Pat. No. Des. 785,950.

(51) Int. Cl.

| | |
|---|---|
| ***A46B 7/02*** | (2006.01) |
| ***A46B 9/02*** | (2006.01) |
| ***A46B 15/00*** | (2006.01) |
| ***A46B 5/00*** | (2006.01) |

(52) U.S. Cl.

CPC ..... *A46B 7/026* (2013.01); *A46B 5/0041* (2013.01); *A46B 9/023* (2013.01); *A46B 15/0095* (2013.01); *A46B 2200/104* (2013.01)

(58) Field of Classification Search

CPC ..... A46B 5/0041; A46B 9/023; A46B 7/026; A46B 5/002; A46B 5/0029; A46B 15/0077; A46B 7/02; A46B 7/023; A46B 7/06; A46B 9/08; A46B 9/10; A46B 9/12; A46B 15/0095; A46B 2200/104

USPC ..... 15/144.1, 184, 185, 203, 169, 201; 132/121, 120, 128, 147, 148, 145, 150, 132/152, 156, 126, 142, 313

See application file for complete search history.

(56) References Cited

U.S. PATENT DOCUMENTS

| | | | | |
|---|---|---|---|---|
| 1,375,681 | A * | 4/1921 | Dennin | A46B 5/0033 132/313 |
| 3,651,532 | A * | 3/1972 | Wettburg | A46B 3/20 132/313 |
| 4,001,910 | A * | 1/1977 | Peilet | A46B 7/023 132/119 |

(Continued)

OTHER PUBLICATIONS

Image of product printed from Internet available at least as early as Jan. 13, 2014 <http://www.amazon.com/Travel-Folding-Mirror-Camping-Compact/dp/B00FROVKD0>.

*Primary Examiner* — Mark Spisich

(74) *Attorney, Agent, or Firm* — Gloria Tsui Yip, Esq.; Gottlieb, Rackman & Reisman, P.C.

(57) ABSTRACT

A hair brush has a head, a handle extending from the head and a plurality of bristles. The head has a front portion, a rear portion and an edge portion. The rear and edge portions define a hollow housing. The front portion is flexible and the plurality of bristles extend therefrom except at a central portion. The front portion engages an inner channel of the edge portion and is movable between convex and concave configurations. When the hair brush is in a collapsed configuration, the front portion is in a concave configuration and it is within the hollow housing to facilitate transport and storage. When the hair brush is in an uncollapsed/extended position, the bristles are outside the hollow housing and ready to be used.

11 Claims, 11 Drawing Sheets

(56) References Cited

U.S. PATENT DOCUMENTS

| | | | | | |
|---|---|---|---|---|---|
| 4,028,768 | A * | 6/1977 | Pascal | A46B 7/026 | 132/119 |
| 4,500,939 | A * | 2/1985 | Gueret | A46B 3/005 | 15/187 |
| 5,185,902 | A * | 2/1993 | Fong | A46B 7/026 | 132/122 |
| 5,323,793 | A * | 6/1994 | Lorenzi | A45D 8/24 | 132/145 |
| 6,196,235 | B1 * | 3/2001 | Kim | A46B 5/0033 | 132/148 |
| 2004/0060571 | A1 * | 4/2004 | Mayeri | A46B 5/0033 | 132/121 |
| 2006/0249169 | A1 * | 11/2006 | Lee | A45D 42/04 | 132/102 |
| 2008/0053473 | A1 * | 3/2008 | Lee | A46B 5/002 | 132/313 |
| 2009/0147081 | A1 * | 6/2009 | Hanson | A45D 20/12 | 348/77 |

* cited by examiner

COLLAPSIBLE HAIR BRUSH

This application is a continuation-in-part of design patent application Ser. No. 29/527,552 filed on May 20, 2015, now U.S. Pat. No. D785,950, which is hereby incorporated by reference.

FIELD OF THE INVENTION

This invention relates to a brush. In particular, an improved hair brush that is collapsible to facilitate its transport and storage and to protect the bristles thereon during transport and storage.

BACKGROUND OF THE INVENTION

Hair brushes and combs are designed to untangle hair. It is ordinary for women and men to carry a brush or comb with them to untangle or smooth out their hair throughout the day. It is troublesome for a user to carry a hair brush in his pocket or bag because the bristles not only take up volume, but also become entangle with other items in the user's pocket or bag. When items entangle or interact with the bristles, the bristles can become damaged and render the hair brush not usable or not as effective.

Prior art brush such as that disclosed in U.S. Patent Application Publication No. 2006/0249169 to Lee sought to overcome the problems of transporting and storing a hair brush and protecting the bristles. The prior art Lee brush provides a flexible membrane 12 that can be popped up (FIG. 1) or popped down (FIGS. 2B and 5) to decrease the volume of the bristles 24 and to protect the bristles 24. To pop the membrane 12 down, a user has to push on the distal tips of the bristles 24 with his fingers or force his fingers in between the bristles, thereby pushing the bristles 24 aside to reach the membrane surface 12 to push it down. Upon the collapse of the bristles 24 to the popped down configuration, the user's fingers may remain trapped among the bristles 24, which may be uncomfortable and would damage the bristles. To pop the membrane 12 up, a user can push on any part of the membrane 12.

Some disadvantages of the prior art Lee brush is that the flexible membrane 12 remain exposed when in the popped down configuration (FIGS. 2A and 5), which is uncomfortable to pushed against and can easily damage the joint between the bristles 24 and the membrane 12 when pushed repeatedly. It also limits the type of joint and bristles that can be used in the prior art brush. For examples, a tapered fused joint is required and a plug and glue joint would not work as it would be painful to push against such joint, which is also unsightly. Also, the size of the brush is not a full size brush, but a very compact version of a hair brush. This is partly due to the unsupported flexible membrane 12, which flexes when being used. Such prior art brush cannot be full size because the flexible membrane 12 would simply popped down upon being used. Additionally, it is very cumbersome to change from the popped up configuration to the popped down configuration, and vice versa, due to the uniformly dispersed bristles on the flexible membrane (which is necessary due to the small size brush). Again, due to the uniformly dispersed bristles and the small size brush, when the membrane 12 changes from the popped down configuration to the popped up configuration, distal ends of the brush can easily become trapped along the annular flange of the top section 16.

Therefore, there is a need for an improved collapsible hair brush that facilitate its transport and storage and protect the bristles that is easy to use and manipulate.

SUMMARY OF THE INVENTION

The present invention is an improved hair brush that is collapsible to facilitate its transport and storage by decreasing the volume of the bristles and to protect the bristles thereon during transport and storage.

The hair brush of the present invention comprises a handle and a head. The head has a front portion, a rear portion and an edge portion. The handle extends from the edge portion of the head. The front portion includes a flexible cushion where a plurality of bristles extend therefrom. The plurality of bristles are uniformly dispersed on the flexible cushion except for the central area. The rear and edge portions form a hollow housing with an opening on the rear portion. The perimeter of the front portion matingly engages an inner channel of the edge portion within the housing.

When the hair brush is configured to be used, the front portion has a convex surface with the plurality of bristles in an uncollapsed/extended/open configuration. When the hair brush is configured to be transported and stored, the front portion has a concave surface with the plurality of bristles in a collapsed/closed configuration. The rear portion is shaped to correspond to and be adjacent to the concave surface of the front portion such that the front portion and the lower ends of the plurality of bristles are within the volume of the housing.

In an alternate embodiment, the handle is pivotably connected to the head. The handle has a concave surface that when the hair brush is configured to be transported and stored, the concave surface of the handle is folded to correspondingly cover and protect the distal ends of the plurality of bristles.

The collapsible hair brush of the present invention advantageously facilitate its transport and storage and protect the bristles thereon during transport and storage that is easy to use and manipulate.

BRIEF DESCRIPTION OF THE DRAWINGS

Preferred embodiments of the present invention have been chosen for purposes of illustration and description and are shown in the accompanying drawings forming a part of the specification wherein.

DETAILED DESCRIPTION OF THE PREFERRED EMBODIMENTS

Figure 1:
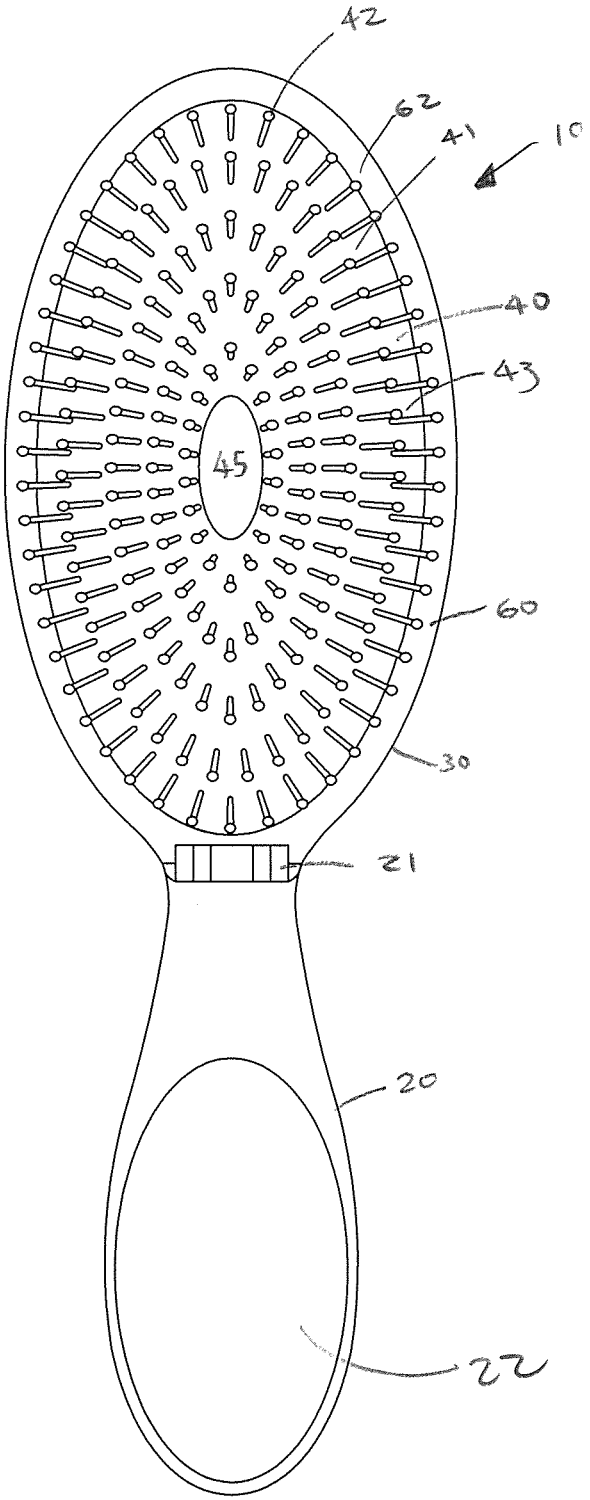
FIG. 1 is a front view of the hair brush of the present invention.
Figure 2:
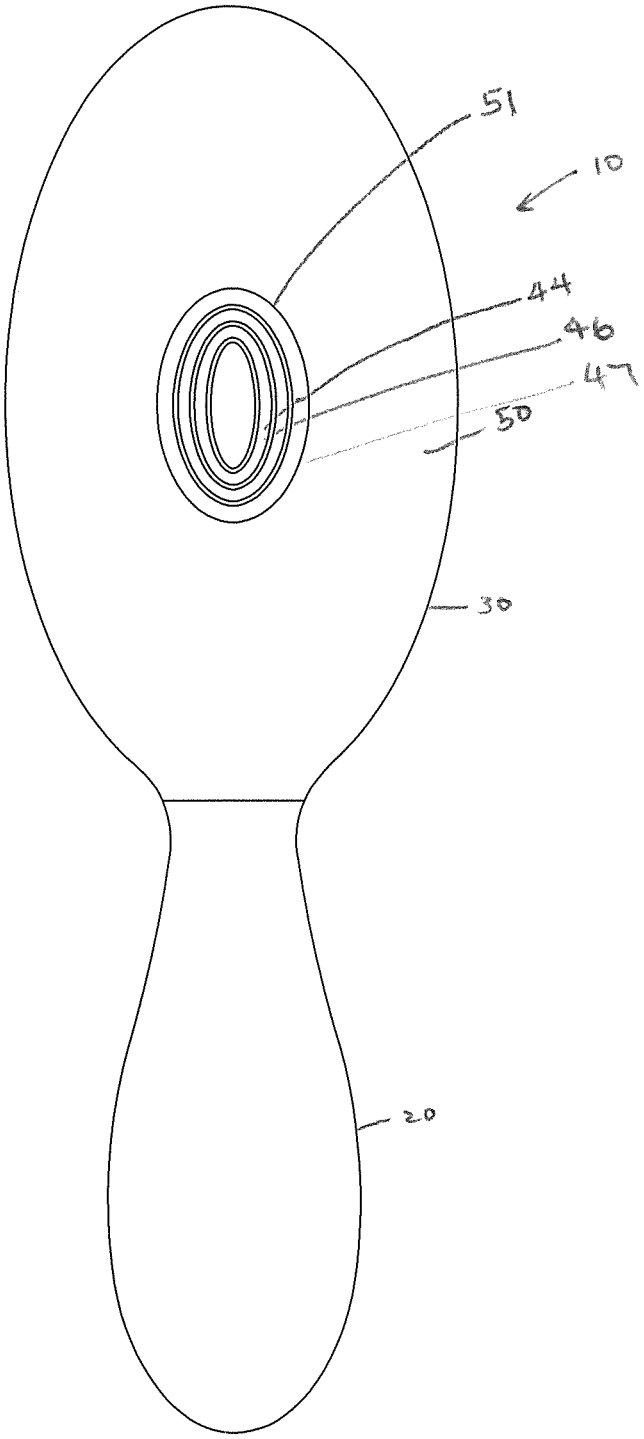
FIG. 2 is a rear view of the hair brush of the present invention.
Figure 3:
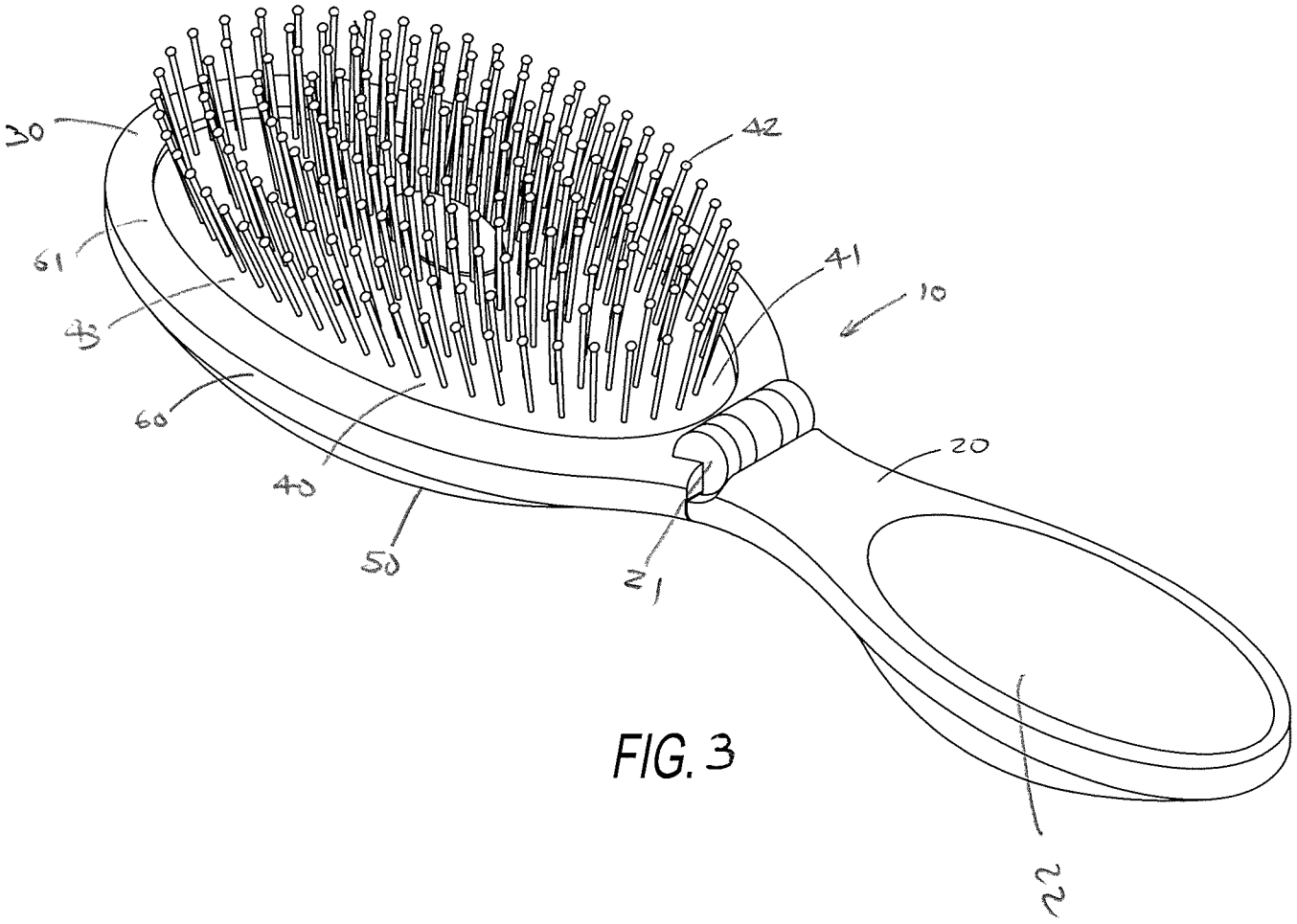
FIG. 3 is a perspective view of the hair brush of the present invention.
Figure 4:
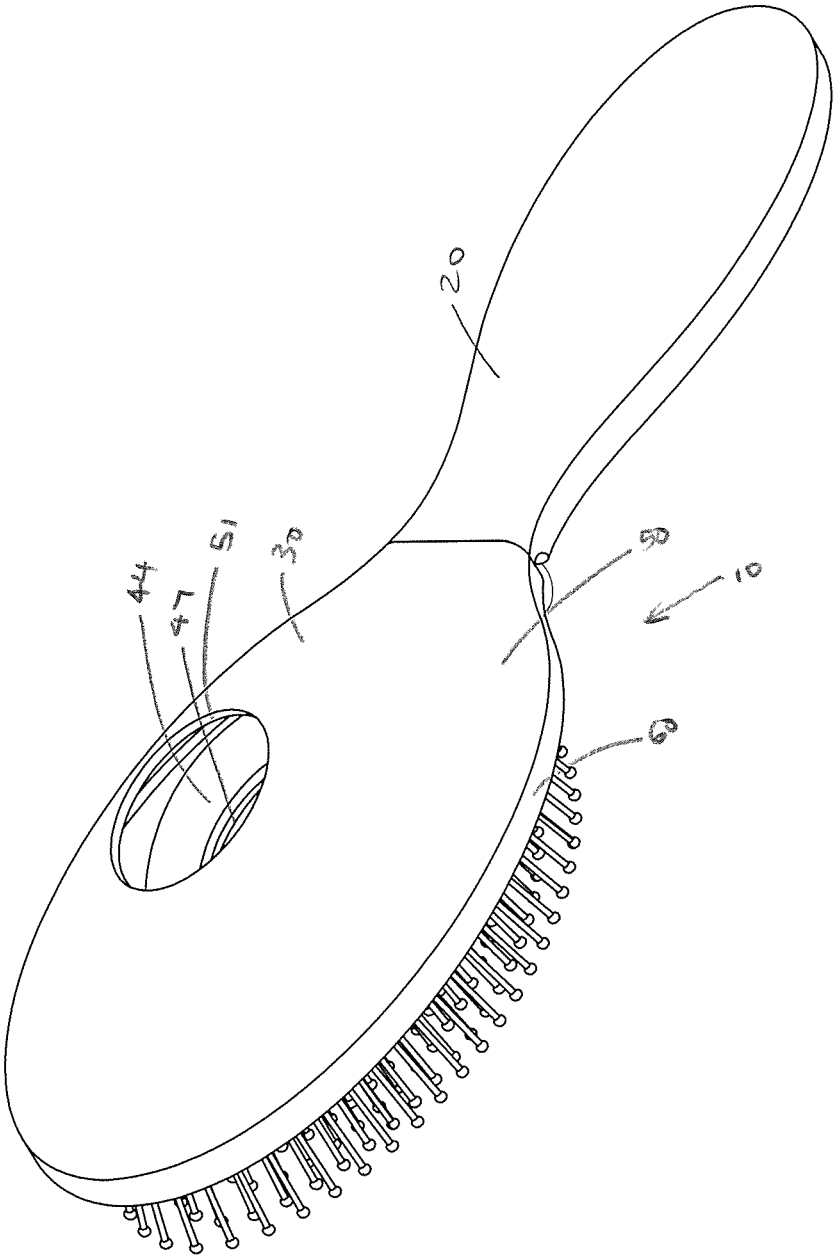
FIG. 4 is another perspective view of the hair brush of the present invention.
Figure 5:
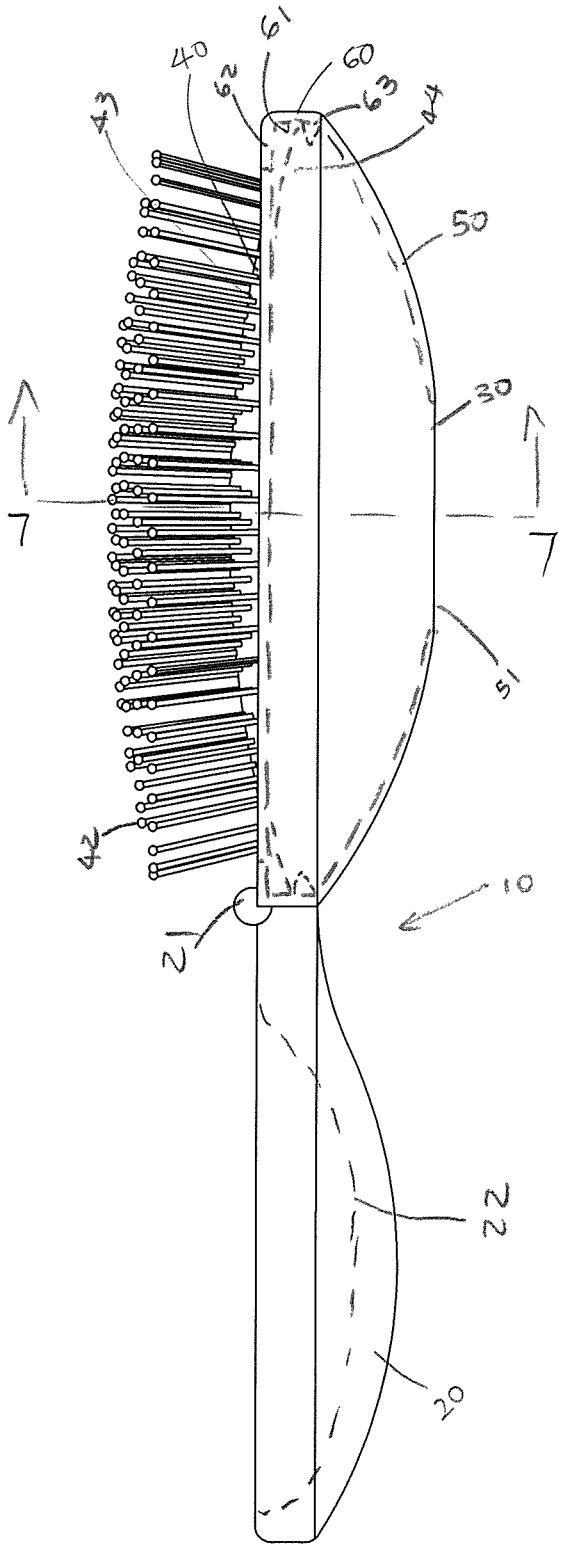
FIG. 5 is a side view of the hair brush of the present invention.
Figure 6:
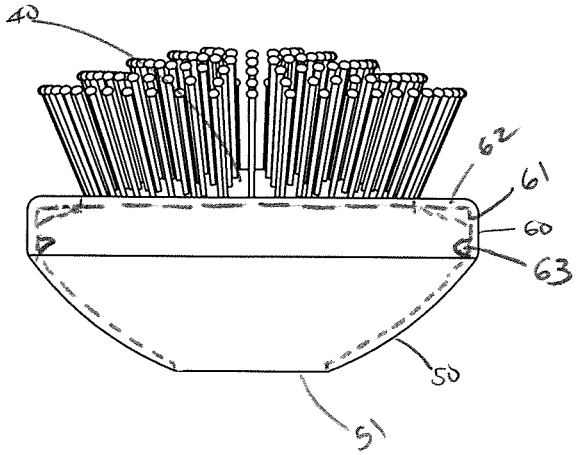
FIG. 6 is a top view of the hair brush of the present invention.
Figure 7:
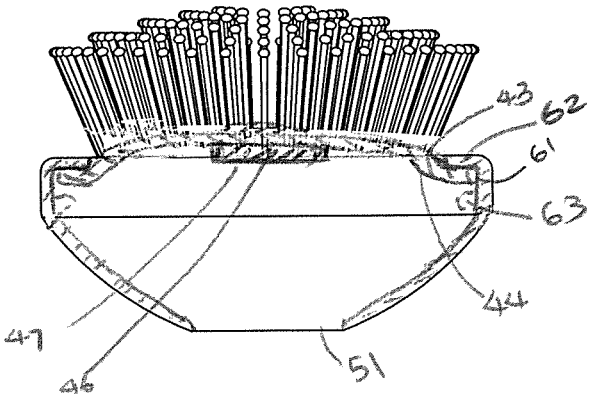
FIG. 7 is a cross-sectional view taken along line 7-7 in FIG. 5.
Figure 8:
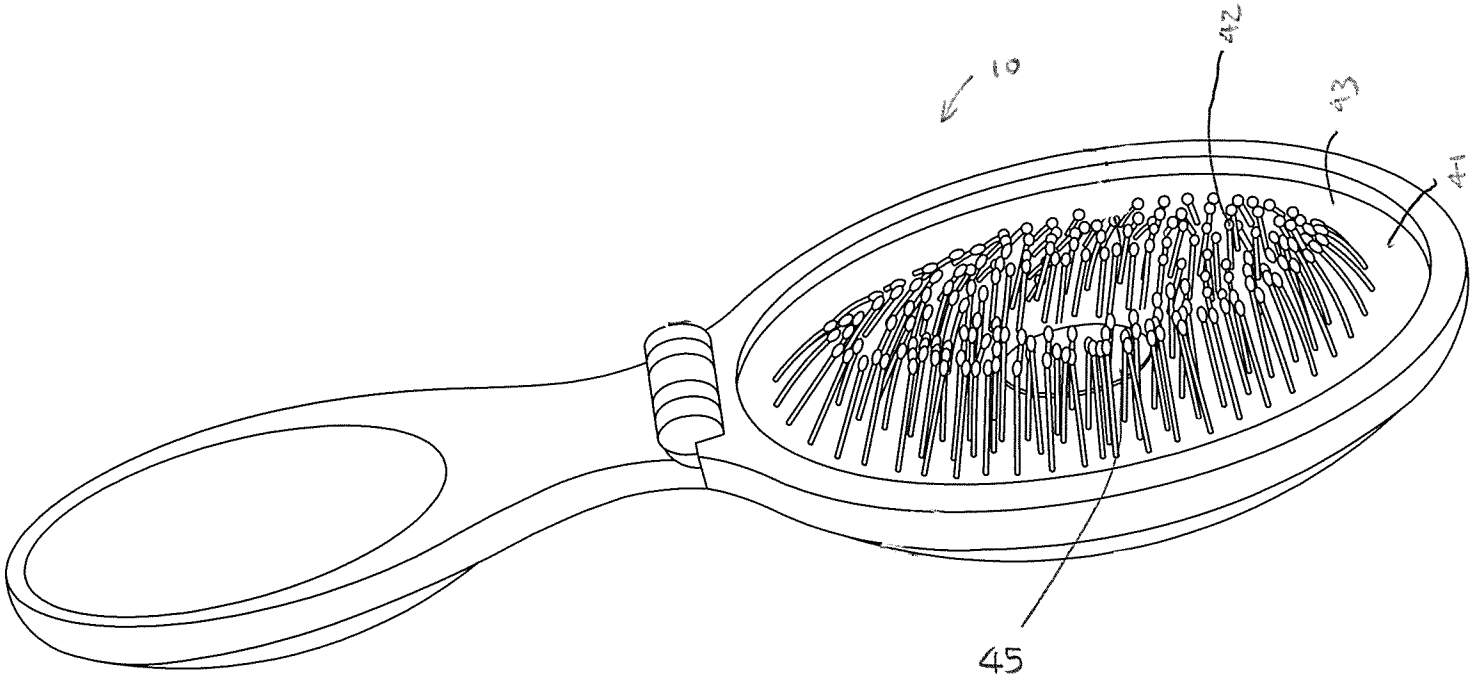
FIG. 8 is a perspective view of the hair brush of the present invention in a collapsed configuration.
Figure 9:
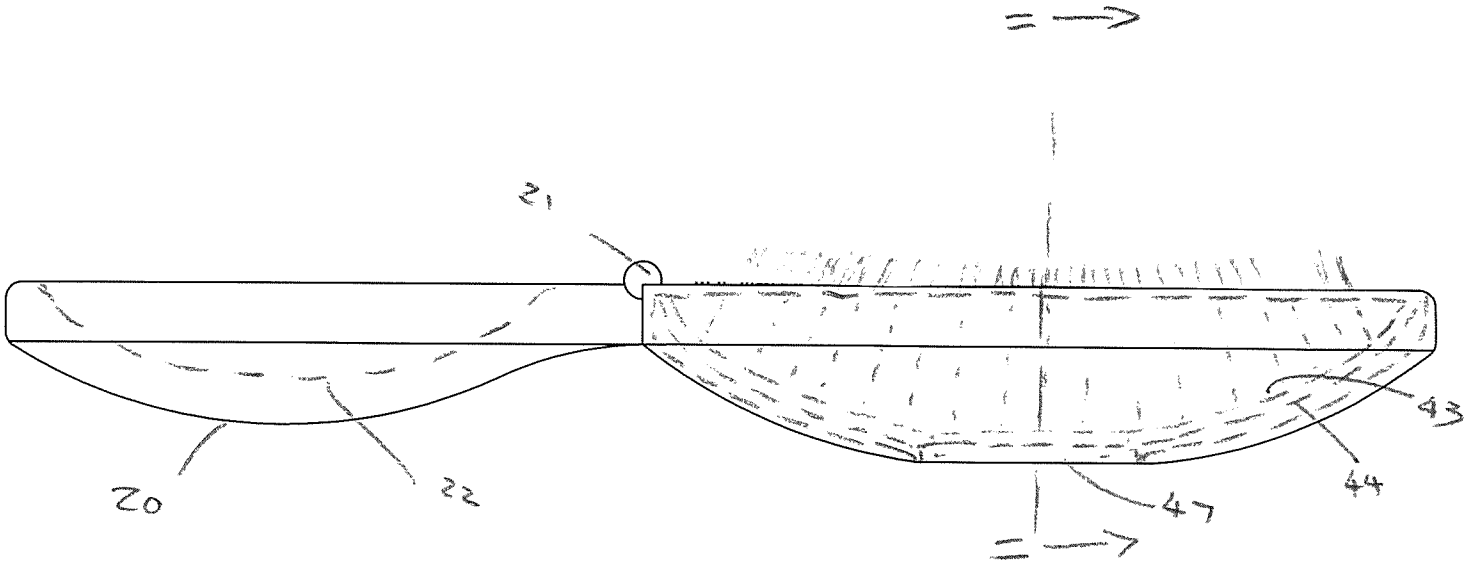
FIG. 9 is a side view of the hair brush of the present invention in a collapsed configuration.
Figure 10:
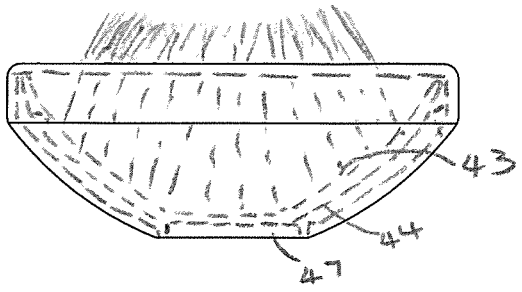
FIG. 10 is a top view of the hair brush of the present invention in a collapsed configuration.
Figure 11:
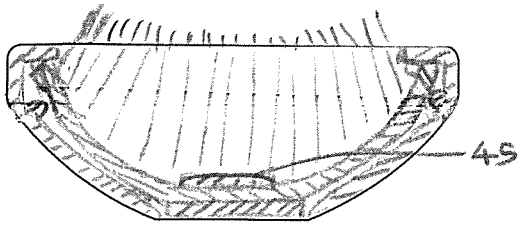
FIG. 11 is a cross-sectional view taken along line 11-11 in FIG. 9.

With reference to the drawings, wherein the same reference number indicates the same element throughout, there is shown in FIGS. 1-7 an improved collapsible hair brush 10 of the present invention. The hair brush 10 of the present invention includes a handle 20 and a head 30. The head 30 has a front portion 40, a rear portion 50, and an edge portion 60.

The front portion 40 includes a flexible cushion 41 where a plurality of bristles 42 extend uniformly from its front face 43 except at a central portion 45. The central portion 45 may have a thin covering thereon. Each bristle 42 is fused, molded, planted and glued or otherwise attached to the flexible cushion 41 as known to one skilled in the art. At a central portion 46 of the rear face 44 of the front portion 40 is a pad 47.

The rear portion 50 and the edge portion 60 form a hollow housing with an opening 51 on the rear portion 50. The edge portion 60 has an upper rim 62 and a flange 63 that define an inner channel 61 therebetween. The perimeter of the flexible cushion 41 matingly engages the inner channel 61 of the edge portion 60.

In the extended/open configuration as shown in FIGS. 1-7, the front portion 40 has a convex surface, with a portion of the front face 43 protruding above the upper rim 62 of edge portion 60. The bristles 42 are splayed and available to brush a user's hair.

FIGS. 8-11 show the hair brush 10 of the present invention in a collapsed/closed configuration for transport and storage. The distal ends of the bristles 42 are close to each other instead of being splayed when in the extended/open configuration. The front portion 40 has a concave surface, with the flexible cushion 41 being completely within the hollow housing formed from the rear portion 50 and the edge portion 60. The rear face 44 is adjacent to the rear portion 50, with the pad 47 filling or covering the opening 51.

To change the hair brush 10 from the collapsed/closed configuration to the extended/open configuration, a user pushes his thumb/finger against the pad 47, instead of having to push against the rear face 43 of the flexible cushion 41 where the joints are as in the prior art, through the opening 51. Such action causes the front face 43 of the flexible cushion 41 to form a convex surface thereby splaying the bristles 42 and readying it for use to brush the user's hair. The presence of the pad 47 provides additional stiffness to the flexible cushion 41, allowing the brush 10 to work similarly to a non-collapsible brush.

To change the hair brush 10 from the extended/open configuration to the collapsed/closed configuration, a user pushes his thumb/finger against the central portion 45 on the front face 43 of the flexible cushion 41. Such action causes the front face 43 of the flexible cushion 41 to form a concave surface thereby collapsing the bristles 42 with the flexible cushion 41 being completely within the hollow housing formed from the rear portion 50 and the edge portion 60. The pad 47 completely covers the opening 51, which is not only aesthetically more pleasing, but also prevents any items or debris from entering the hollow housing when the brush 10 is being transported or stored.

Figure 12:
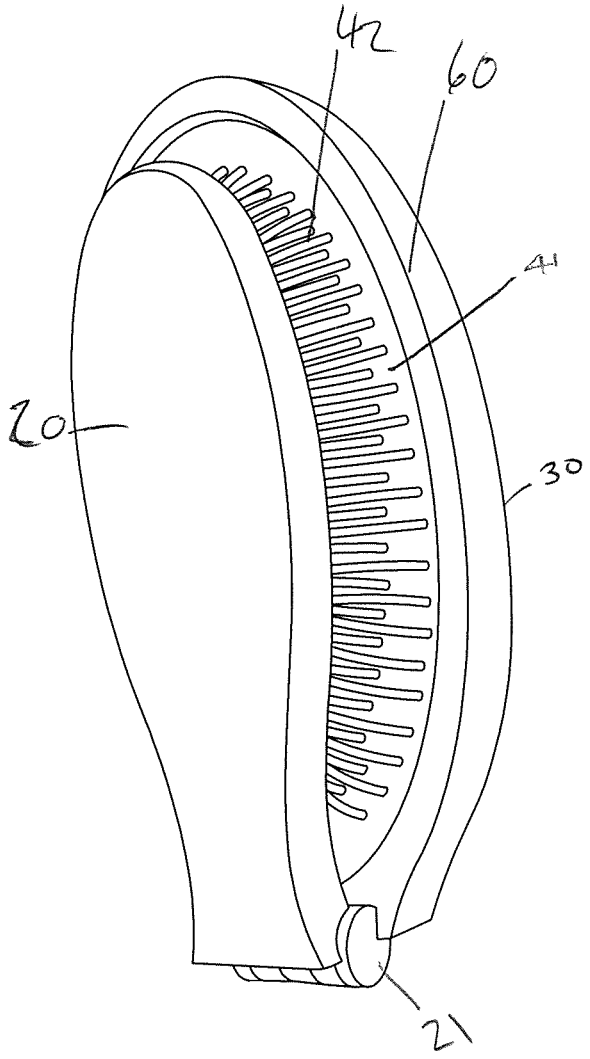
FIG. 12 is a perspective view of the hair brush of the present invention with the handle in a folded configuration.
Figure 13:
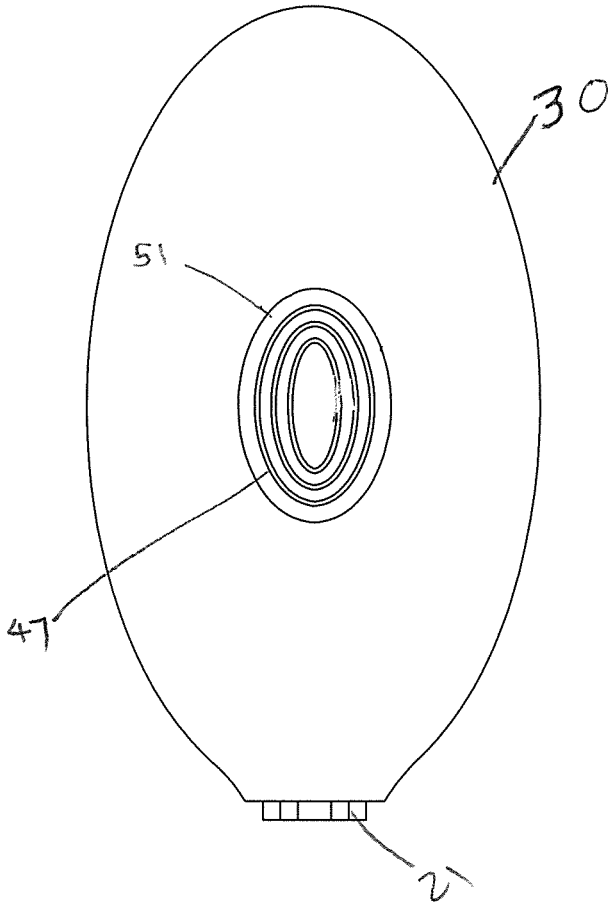
FIG. 13 is a rear view of the hair brush of the present invention with the handle in a folded configuration.

As shown in the figures, the handle 20 extends from the edge portion 60 and is connected to the head 30 via a hinge element 21. Handle 20 has a convex surface 22. FIGS. 12-13 show the hair brush 10 with the handle 20 in a folded configuration. Advantageously, the shape of the handle 20 and the convex surface 22 correspondingly complement and overlap the distal ends of the bristles 42 in the collapsed/closed configuration to further provide protection to the bristles 42. The hinge element 21 that allows the handle 20 to be folded over the head 30 can be any hinge element known to one skilled in the art. The hinge element 21 may also be spring-loaded to be biased in either the folded or unfolded configuration. Although the figures show the hair brush 10 has a handle 20 that is hingedly connected to the edge portion 60, the handle 20 can be also be integrally formed and not movable with respect to the head 30.

The figures show the head 30 of the hair brush 10 having an oval shape and the handle 20 having a corresponding, but smaller, oval shape. However, other shapes, such as generally circular, generally rectangular, etc. will similarly work. Further, it is not necessary for the shape of the handle 20 to correspond to the shape of the head 30.

The bristles 42 of the hair brush 10 can be any type of bristles, such as synthetic, nylon, natural boars' hair, or a combination of different bristles, and any thickness and stiffness due to the unique construction of the hair brush 10 of the present invention. However, the hair brush 10 is most advantageous in protecting bristles that are flexible.

The features of the invention illustrated and described herein are the preferred embodiments. Therefore, it is understood that the specification is intended to cover unforeseeable embodiments with insubstantial differences that are within the spirit of the specification.

What I claim is:

1. A hair brush comprising:

a head having a front portion, a rear portion and an edge portion, said edge portion having an upper rim and a flange defining an inner channel therebetween;

said rear portion and said edge portion defining a hollow housing, said rear portion has a central opening;

said front portion having a front face, an opposite rear face, a central portion and a perimeter that engages said inner channel, and is flexible, movable between a convex configuration and a concave configuration; said rear face has a pad at said central portion;

a handle extending from said edge portion of said head;

a plurality of bristles extending uniformly from said front face of said front portion, except at said central portion where bristles would have been present from such uniformity, there are no bristles;

wherein when said front portion is in a concave configuration, said front portion is completely within said hollow housing and said rear face of said front portion is adjacent said rear portion with said pad matingly covers said central opening of said rear portion completely, and when said front portion is in a convex configuration, said bristles are outside said hollow housing.

2. The hair brush of claim 1 further comprising a hinge element connecting said handle to said edge portion, thereby allowing said handle to be movable from a folded configuration and unfolded configuration, wherein when said front portion is in a concave configuration and said handle is in a folded configuration, said handle overlap said bristles.

3. The hair brush of claim 1 wherein said handle has a convex surface wherein said convex surface overlaps said bristles when said front portion is in a concave configuration and said handle is in a folded configuration.

4. The hair brush of claim 1 wherein said head has a predetermined shape.

5. The hair brush of claim 4 wherein said handle has a corresponding predetermined shape smaller than said head.

6. The hair brush of claim 1 wherein said head has an oval shape.

7. The hair brush of claim 1 wherein said bristles are made of nylon.

8. The hair brush of claim 1 wherein said bristles are made of natural hair.

9. The method of collapsing a hair brush to facilitate its transport and storage, comprising the steps of:

providing a hair brush having a head, a handle and a plurality of bristles;

said head has a front portion, a rear portion and an edge portion;

said edge portion has an upper rim and a flange defining an inner channel therebetween, said rear portion and said edge portion define a hollow housing, said front portion has a front face, an opposite rear face, a central portion and a perimeter that engages said inner channel, and is flexible, movable between a convex configuration and a concave configuration;

said handle extends from said edge portion of said head;

said plurality of bristles extend uniformly from said front face of said front portion except at said central portion;

said rear portion has an opening and said rear face has a pad at said central portion;

wherein said front portion is in an uncollapsed, convex, configuration with said bristles outside said hollow housing; and pushing said central portion of said front portion towards said hollow housing such that said front portion is in a concave configuration with said front portion completely within said hollow housing and said rear face of said front portion is adjacent said rear portion with said pad matingly covers said opening of said rear portion.

10. The method of claim 9 further comprising the steps of:

providing a hinge element connecting said handle to said head such that said handle is movable from a folded configuration to an unfolded configuration; and folding said handle to overlap said bristles.

11. The method of uncollapsing a hair brush from a collapsed configuration for use, comprising the steps of:

providing a hair brush having a head, a handle and a plurality of bristles;

said head has a front portion, a rear portion and an edge portion;

said edge portion has an upper rim and a flange defining an inner channel therebetween, said rear portion and said edge portion define a hollow housing, said front portion has a front face, an opposite rear face, central portion and a perimeter that engages said inner channel, and is flexible, movable between a convex configuration and a concave configuration;

said handle extends from said edge portion of said head;

said plurality of bristles extend uniformly from said front face of said front portion except at said central portion;

said rear portion has an opening and said rear face has a pad at said central portion;

wherein said front portion is in a collapsed, concave, configuration with said front portion completely within said hollow housing and said rear face of said front portion is adjacent said rear portion with said pad matingly covers said opening of said rear portion; and pushing said central portion of said front portion away from said rear portion via said opening such that said front portion is in an uncollapsed, convex, configuration with said bristles outside said hollow housing ready to be used.

* * * * *